US006459771B1

(12) United States Patent
Mancini

(10) Patent No.: US 6,459,771 B1
(45) Date of Patent: Oct. 1, 2002

(54) METHOD FOR FABRICATING PRECISION FOCUSING X-RAY COLLIMATORS

(75) Inventor: Derrick C. Mancini, Riverside, IL (US)

(73) Assignee: The University of Chicago, Chicago, IL (US)

( * ) Notice: Subject to any disclaimer, the term of this patent is extended or adjusted under 35 U.S.C. 154(b) by 0 days.

(21) Appl. No.: 09/667,904

(22) Filed: Sep. 22, 2000

(51) Int. Cl.[7] ..... G21K 1/00
(52) U.S. Cl. ..... 378/154; 378/34
(58) Field of Search ..... 378/149, 154, 378/34

(56) References Cited

U.S. PATENT DOCUMENTS

| | | | | |
|---|---|---|---|---|
| 4,288,697 | A | | 9/1981 | Albert |
| 4,951,305 | A | | 8/1990 | Moore et al. |
| 5,099,134 | A | | 3/1992 | Hase et al. |
| 5,231,655 | A | | 7/1993 | Wei et al. |
| 5,303,459 | A | | 4/1994 | Kurakake |
| 5,949,850 | A | * | 9/1999 | Tang ..... 378/154 |

* cited by examiner

*Primary Examiner*—Craig E. Church
(74) *Attorney, Agent, or Firm*—Joan Pennington

(57) ABSTRACT

A method is provided for fabricating precision x-ray collimators including precision focusing x-ray collimators. Fabricating precision x-ray collimators includes the steps of using a substrate that is electrically conductive or coating a substrate with a layer of electrically conductive material, such as a metal. Then the substrate is coated with layer of x-ray resist. An intense radiation source, such as a synchrotron radiation source, is utilized for exposing the layer of x-ray resist with a pattern of x-ray. The pattern delineates a grid of apertures to collimate the x-rays. Exposed parts of the x-ray resist are removed. Regions of the removed x-ray resist are electroplated. Then remaining resist is optionally removed from the substrate. When exposing the layer of x-ray resist with a pattern of x-ray for non-focusing collimators, the substrate is maintained perpendicular to impinging x-rays from the synchrotron radiation source; and the substrate is scanned vertically. For precision focusing x-ray collimators, the substrate is scanned vertically in the z-direction while varying the angle of inclination of the substrate in a controlled way as a function of the position of the z-direction during the scan.

12 Claims, 4 Drawing Sheets

METHOD FOR FABRICATING PRECISION FOCUSING X-RAY COLLIMATORS

The United States Government has rights in this invention pursuant to Contract No. W-31-109-ENG-38 between the United States Government and Argonne National Laboratory.

FIELD OF THE INVENTION

The present invention relates to a new and improved method for fabricating precision x-ray collimators including precision focusing x-ray collimators.

DESCRIPTION OF THE RELATED ART

X-ray collimators are devices that select parallel, divergent or convergent rays from an uncollimated source. Collimators are used in nuclear medicine and x-ray imaging to improve spatial resolution and sensitivity of the imaging system. A typical imaging system consists of a point radiation source and an image recording device, the object to image being placed between the radiation source and the detector. As the radiation interacts with the tissue, the radiation becomes attenuated as well as scattered by the tissue. Without intervention, both the scattered radiation and primary radiation from the patient are recorded in a radiographic image. Subject contrast and the signal to noise ratio of details in the image are reduced. In some types of x-rays, the presence of scatter can cause up to a 50% reduction in contrast and up to a 55% reduction in signal to noise ratio. It is important therefore to be able to fabricate collimators that permit the primary radiation to pass through, while attenuating or eliminating the scattered radiation.

A key problem is the need for high resolution and improved image quality in nuclear medicine and x-ray imaging. In nuclear medicine imaging, often more than 99% of the incoming photon flux is absorbed by the collimator, in exchange for the best spatial resolution provided by the particular hole-shape and hole pattern of the collimator in use. As a result, the photon statistics, and hence the image quality, is very limited. Conventional techniques for manufacturing collimators have great limitations on the hole-shape, hole pattern, and septa thickness that can be produced, which in turn results in relatively poor resolution and image quality. Typical spatial resolutions encountered in nuclear medicine imaging currently range from a few millimeters to centimeters, pixel count uncertainty can be worse than 30%, and the overall quantitative inaccuracy can be worse than 25%. If a sub-millimeter spatial resolution can be achieved, and quantitative measurements can be certain within 5%, the clinical utility of nuclear medicine imaging methods can be greatly expanded with high diagnostic accuracy. Similar situations exist in x-ray imaging, beta-ray imaging, and other radiological imaging techniques that use collimator devices to achieve or improve spatial resolution and image quality.

A number of methods have been suggested for fabricating collimator devices. For example, U.S. Pat. Nos. 4,288,697; 4,951,305; 5,099,134; 5,231,655; and 5,303,459 describe various methods for fabricating collimators. Typically the anti-scatter grids are one-dimensional arrays of lead lamella, sandwiched between more x-ray transparent spacer materials, such as aluminum, carbon fiber or wood.

A need exists for a new and improved method for fabricating precision x-ray collimators.

A principal object of the present invention is to provide a new and improved method for fabricating precision focusing x-ray collimators.

It is another object of the present invention to provide such an improved method for fabricating precision focusing x-ray collimators that utilizes LIGA (German abbreviation of three major process steps, lithography, electroplating and molding) fabrication methods along with a synchrotron radiation from an electron storage ring, such as the Advanced Photon Source (APS) at Argonne National Laboratory.

It is another object of the present invention to provide such an improved method for fabricating precision focusing x-ray collimators that includes enhanced capabilities to move the substrate during exposure during LIGA.

SUMMARY OF THE INVENTION

In brief, a method is provided for fabricating precision x-ray collimators including precision focusing x-ray collimators. Fabricating precision focusing x-ray collimators includes the steps of using a substrate that is electrically conductive or coating a substrate with a layer of electrically conductive material, such as a metal. Then the substrate is coated with a layer of x-ray resist. An intense collimated radiation source is utilized for exposing the layer of x-ray resist with a pattern of x-ray. The pattern delineates a grid of apertures to collimate the x-rays. Exposed parts of the x-ray resist are removed. Regions of the removed x-ray resist are electroplated. Then remaining resist is optionally removed from the substrate.

In accordance with features of the invention, when exposing the layer of x-ray resist with a pattern of x-ray for non-focusing collimators, the substrate is maintained perpendicular to impinging x-rays from the synchrotron radiation source; and the substrate is scanned vertically. For precision focusing x-ray collimators, the substrate is scanned vertically in the z-direction while varying the angle of inclination of the substrate in a controlled way as a function of the position of the z-direction during the scan.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

Figure 1A:
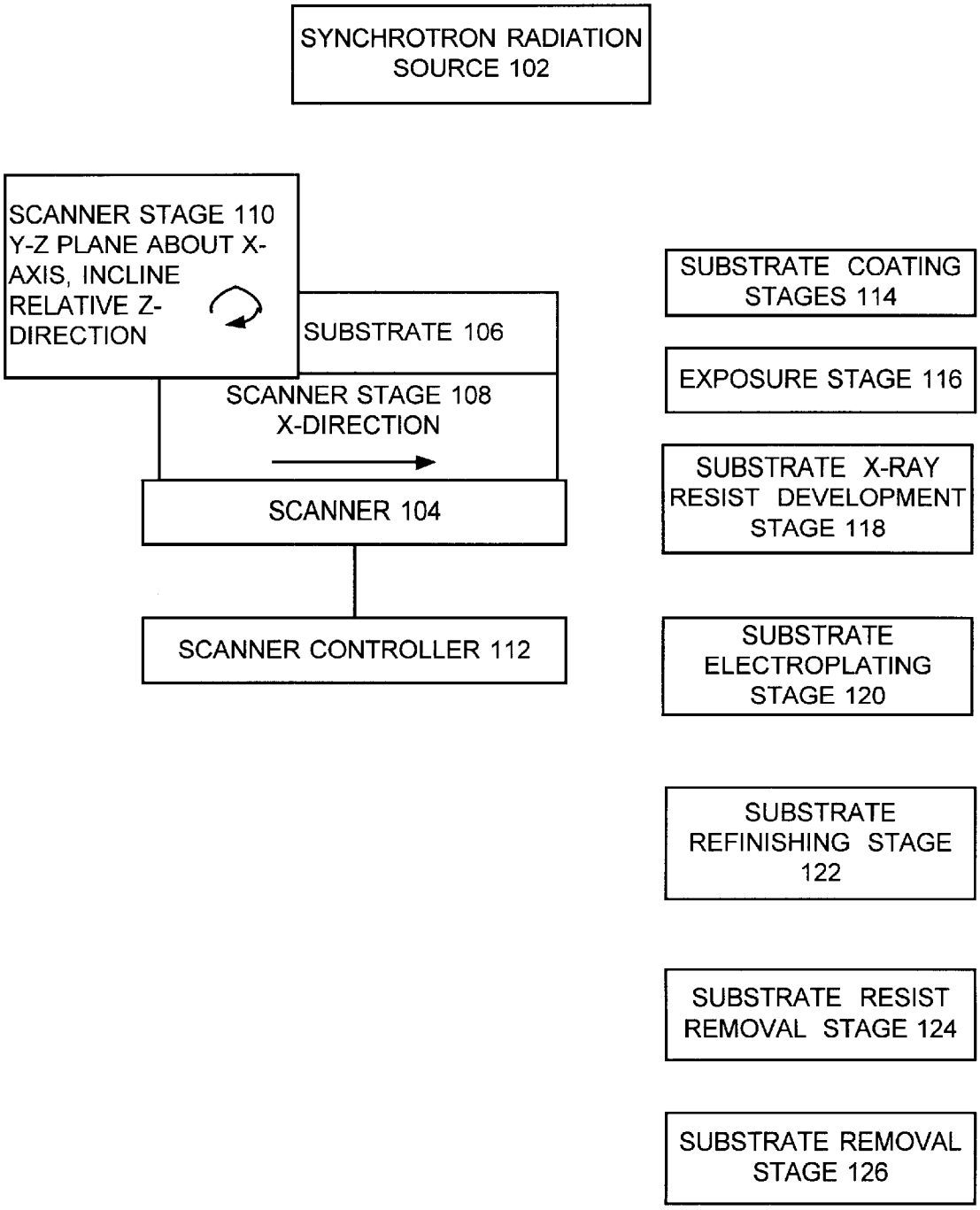
FIG. 1A is a block diagram representation of a precision focusing x-ray collimator fabricating system in accordance with the present invention.

Having reference now to the drawings, in FIG. 1A, there is shown a precision focusing x-ray collimator fabricating system in accordance with the present invention generally designated by the reference character 100. It should be understood that precision focusing x-ray collimator fabricating system 100 can also be used for fabricating non-focusing x-ray collimators. Precision focusing x-ray collimator fabricating system 100 includes a highly collimated synchrotron radiation source 102, such as an Advanced Photon Source (APS) at Argonne National Laboratory.

Figure 1B:
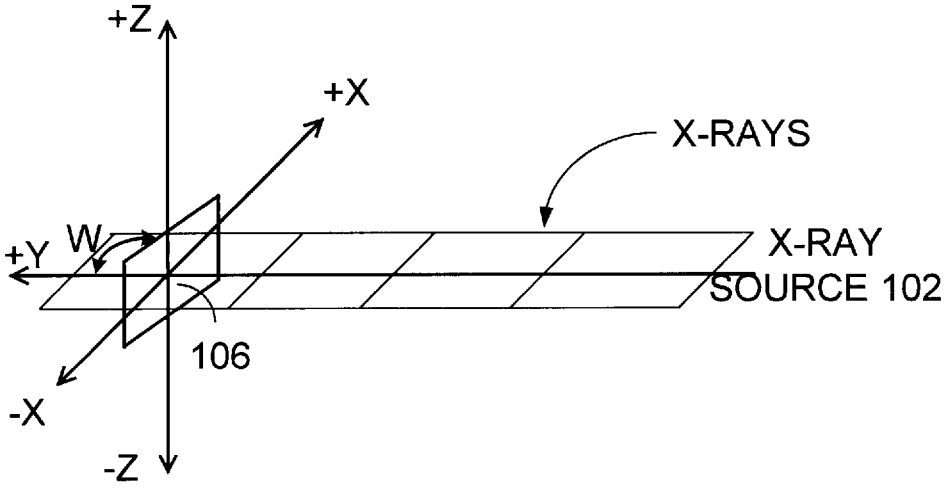
FIGS. 1B and 1C are charts illustrating an exposure stage of the precision focusing x-ray collimator fabricating system of FIG. 1A.
Figure 1C:
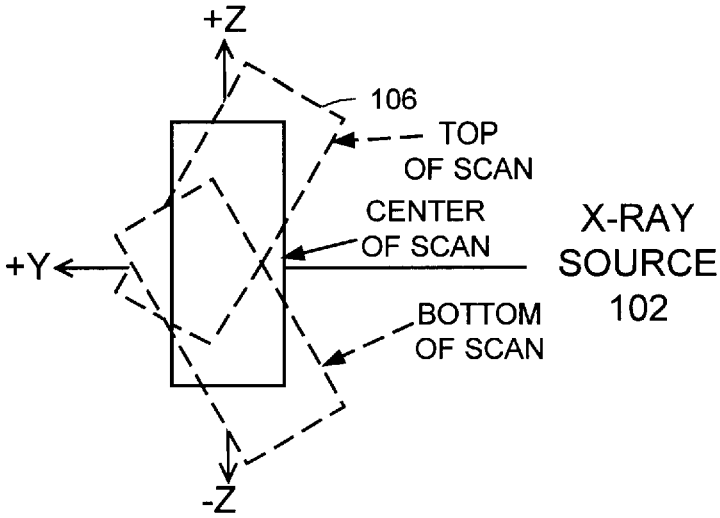

Referring also to FIGS. 1B and 1C, synchrotron radiation source 102 is used with a scanner 104 for moving a substrate 106. For a non-focusing collimator, scanner 104 includes a first stage 108 mounted vertically or perpendicular to the beam to move the substrate 106 in the Z-direction while the substrate 106 is scanned vertically in the Z-direction. For a focusing collimator, scanner 104 includes a second stage 110 mounted on the first stage 108 that can rotate in the Y-Z plane about the X-axis, at a varying angle W of inclination of the substrate 106 as a function of the position of the Z-direction during the scan. A scanner controller 112 operatively controls the scanner 104 and stages 108, 110 with precise computer control, such as a multiaxis servo motor controller or with an arrangement of appropriate mechanical linkages. Precision focusing x-ray collimator fabricating system 100 includes a plurality of substrate processing stages including substrate coating stages 114, an exposure stage 116, a substrate x-ray resist development stage 118, a substrate electroplating stage 120, an optional substrate refinishing stage 122, an optional substrate resist removal stage 124, and an optional substrate removal stage 126.

Figure 1D:
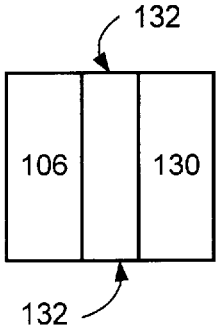
FIG. 1D is a diagram illustrating a substrate together with a mask of the precision focusing x-ray collimator fabricating system of FIG. 1A.

Referring to FIG. 1D, there is shown the substrate 106 together with a mask 130 that can be used for exposure to define a pattern of x-ray. The mask 130 is clamped to the substrate as indicated by lines 132 to provide the mask 130 in proximity and fixed to the substrate 106 between the substrate 106 and the highly collimated x-ray radiation source 102.

Figure 2:
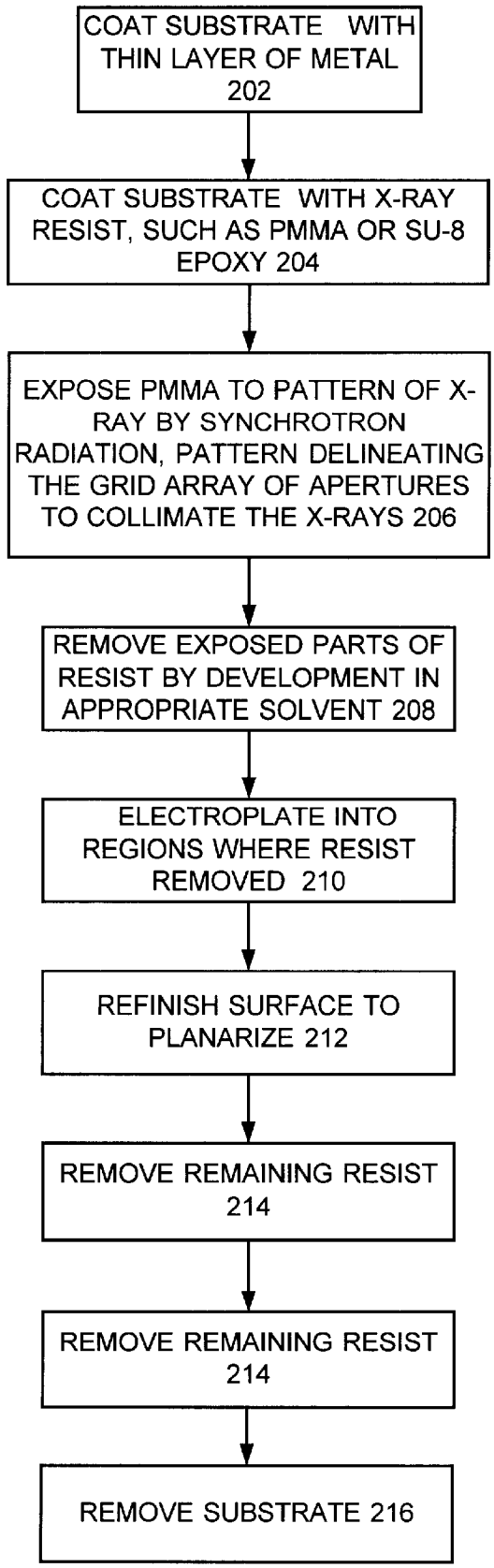
FIGS. 2 and 3 are charts illustrating exemplary sequential steps for fabricating precision focusing x-ray collimators in accordance with the present invention.
Figure 3:
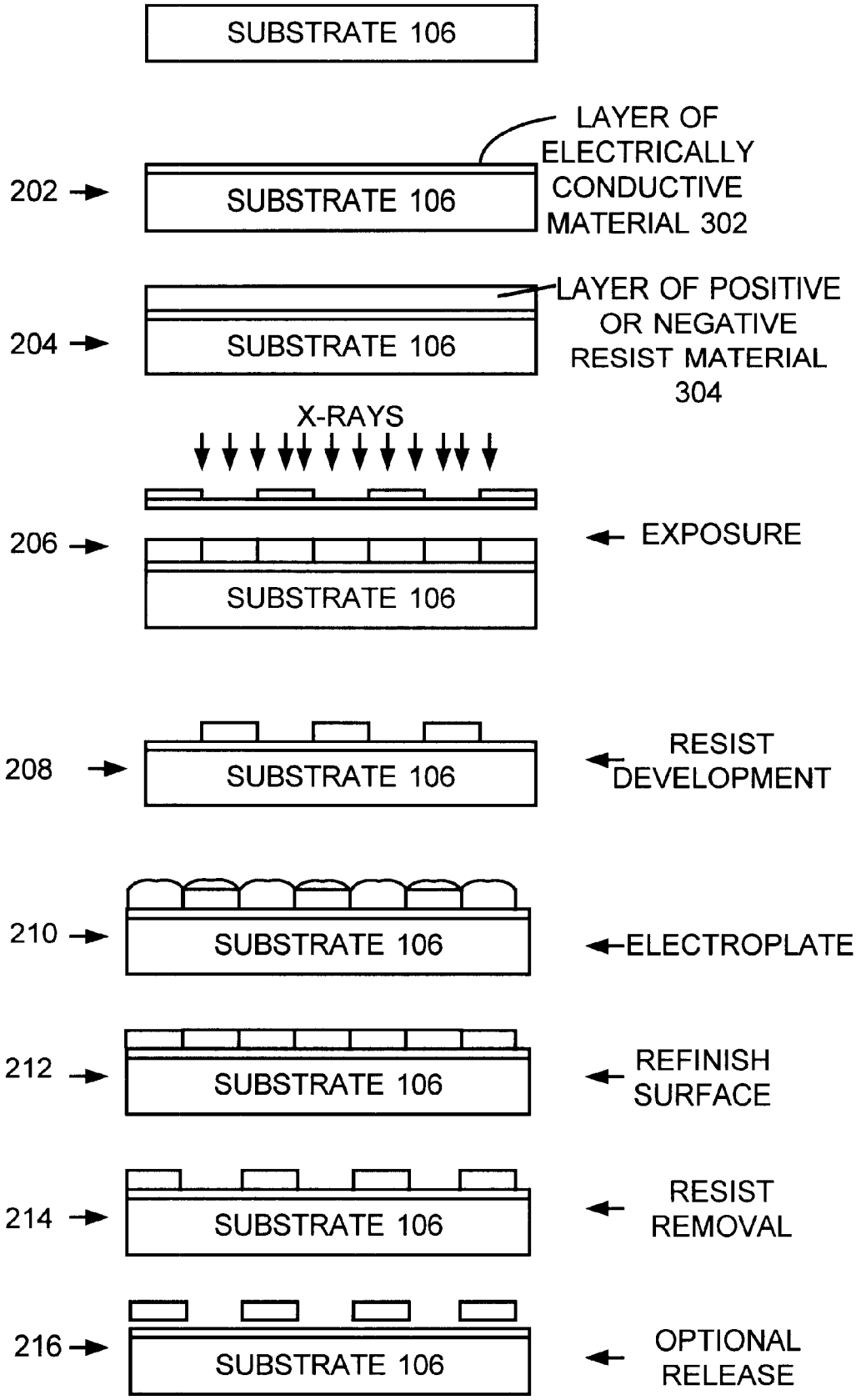

Referring now the FIGS. 2 and 3, there are shown exemplary sequential steps for fabricating precision focusing x-ray collimators in accordance with the present invention. First a substrate 106 that is electrically conductive is used or the substrate 106 is coated with a thin layer of electrically conductive material 302, such as a metal suitable for use as a plating base for subsequent electroforming as indicated in a block 202. The substrate 106 may be x-ray transparent or not. Next, the substrate is coated with a layer of positive or negative x-ray resist, such as positive x-ray resist polymethylmethacrylate (PMMA), or a negative x-ray resist SU-8 epoxy described by U.S. Pat. No. 4,882,245 owned by IBM Corporation, of sufficient thickness such as 100 $\mu$m to many mm, with appropriate adhesion promoters as necessary as indicated in a block 204. The x-ray resist is exposed to a pattern of x-ray by way of the synchrotron radiation source 102; the pattern delineating the grid or array of apertures to collimate the x-rays as indicated in a block 206. The exposed parts of the PMMA are removed by development in an appropriate solvent as indicated in a block 208. Metal capable of absorbing x-rays, such as gold, nickel, copper, platinum, zinc, lead, tin and alloys thereof, or another galvanic metal, is electroplated into the regions where the x-ray resist has been removed, starting from the previously deposited plating base as indicated in a block 210. Optionally, the surface is refinished to planarize as indicated in a block 212. Next remaining resist is optionally removed as indicated in a block 214. Finally, an optional substrate removal to release the grid may be provided as indicated in a block 216.

During the exposure of the x-ray resist 304 carried by the substrate 106 to a pattern of x-ray by way of the synchrotron radiation source 102 at block 206 in FIGS. 2 and 3 can be varied to fabricate non-focusing or precision focusing x-ray collimators in accordance with the present invention. During exposure for non-focusing x-ray collimators, the substrate 106 is normally kept perpendicular to the impinging x-rays. For example, assume that the x-rays are propagated horizontally in the Y-direction as shown in FIG. 1B. With the synchrotron radiation source 102, the x-rays from the electron storage ring bend magnet, while highly collimated, are confined to a horizontal plane, such as a plane in the X-direction. As a result, to expose a two-dimensional area on the substrate 106, the substrate is scanned vertically in the Z-direction. If the substrate 106 is aligned to the X-Z plane, the x-rays will impinge normal to the substrate surface and the final collimator will provide collimation in the same direction, without focusing. During exposure for precision focusing x-ray collimators, the substrate is scanned in the Z-direction while the angle of inclination of the substrate is varied as a function of the position in the Z-direction during the scan to produce the precision focusing x-ray collimators.

In accordance with a feature of the invention, when the substrate 106 is inclined with respect to the Z-direction, while still aligned in the X-direction, the exposure has the same relative angle to the substrate, and the final collimator provides collimation in the inclined direction. A collimator can be formed that focuses in one direction by changing the angle the substrate forms with respect to the exposing x-rays while the substrate 106 is being scanned through the beam in the Z-direction. This is done by placing the substrate 106 on the scanner stage 110 that can rotate in the Y-Z plane about the X-axis, and changing the angle as the substrate 106 is being scanned vertically in the Z-direction. The angle of inclination can be controlled mechanically by fixing an arm to the scanner stage 110 and to the position of the desired focus located in the plane of the exposing x-rays. Alternatively, the angle of inclination can be precisely controlled with the scanner controller 112.

It should be understood that the production of a collimator that focuses in two directions can be achieved by first exposing through a grating mask in one direction, then rotating the substrate by 90 degrees in the X-Z plane while keeping the grating mask fixed. Then exposing again so that the sum of the exposures is a two-dimensional grid with a variable angle of inclination with respect to the substrate surface as a function of distance from the center of both the X and Z directions. Also, by selectively varying the relationship of the angle of inclination to the Z-position, a resulting collimator is produced that focuses at different distances for X versus Z, or may provide different focus distance as a function of the distance from the center of the collimator.

While the present invention has been described with reference to the details of the embodiments of the invention shown in the drawing, these details are not intended to limit the scope of the invention as claimed in the appended claims.

What is claimed is:

1. A method for fabricating precision x-ray collimators including precision focusing x-ray collimators comprising the steps of:

providing an electrically conductive substrate;

coating said substrate with a layer of x-ray resist;

utilizing an intense collimated radiation source for exposing said layer of x-ray resist with a pattern of x-ray; said pattern delineating a grid of apertures to collimate the x-rays defined by a grating mask disposed proximate to said substrate; said pattern defined by first scanning said substrate vertically in a z-direction while varying an angle of inclination of said substrate as a function of a vertical position during the first scan; rotating the substrate by 90 degrees in an X-Z plane while keeping said grating mask fixed; and second scanning said rotated substrate vertically in said z-direction while varying said angle of inclination of said substrate as a function of a vertical position during the second scan for fabricating x-ray collimators having precision focusing in two directions;

removing exposed parts of said x-ray resist; and electroplating regions of said removed x-ray resist.

2. A method for fabricating precision x-ray collimators as recited in claim 1 wherein the step of providing an electrically conductive substrate includes the step of coating a substrate with a layer of electrically conductive material.

3. A method for fabricating precision x-ray collimators as recited in claim 2 wherein the step of coating a substrate with a layer of electrically conductive material includes the steps of coating a substrate with a layer of metal.

4. A method for fabricating focusing x-ray collimators as recited in claim 1 wherein the step of utilizing an intense collimated radiation source for exposing said layer of x-ray resist with a pattern of x-ray includes the steps of utilizing a synchrotron radiation source for exposing said layer of x-ray resist with a pattern of x-ray.

5. A method for fabricating precision x-ray collimators as recited in claim 1 wherein said first and second scanning steps produce x-ray collimators having different focus distance relative to the X direction versus the Z direction.

6. A method for fabricating precision x-ray collimators as recited in claim 1 wherein said first and second scanning steps produce x-ray collimators having different focus distance as a function of the distance from the center of the collimator.

7. A method for fabricating precision focusing x-ray collimators as recited in claim 1 wherein the step of utilizing an intense collimated radiation source for exposing said layer of x-ray resist with said pattern of x-ray includes the steps of utilizing a two stage scanner, a first stage of said two stage scanner for moving said substrate in a first direction and a second stage of said two stage scanner mounted on said first stage for rotating said substrate in a plane about the first direction.

8. A method for fabricating precision x-ray collimators as recited in claim 1 further includes the step of removing remaining resist from said substrate after electroplating regions of said removed x-ray resist.

9. A method for fabricating precision x-ray collimators as recited in claim 1 wherein the step of coating said substrate with said layer of x-ray resist includes the steps of coating said sub strate with a positive x-ray resist polymethylmethacrylate (PMMA) or a negative x-ray resist epoxy.

10. A method for fabricating precision x-ray collimators as recited in claim 1 wherein the step of removing exposed parts of said x-ray resist includes the steps of removing exposed parts of said x-ray resist polymethylmethacrylate (PMMA) or said negative x-ray resist epoxy.

11. A method for fabricating precision x-ray collimators as recited in claim 1 wherein the step of electroplating regions of said removed x-ray resist includes the step of electroplating regions of said removed x-ray resist with a metal capable of absorbing x-rays.

12. A method for fabricating precision x-ray collimators as recited in claim 11 wherein the step of electroplating regions of said removed x-ray resist with said metal capable of absorbing x-rays includes the steps of electroplating one of gold, nickel, copper, platinum, zinc, lead, tin and alloys thereof, or another galvanic metal into regions of said removed x-ray resist.

* * * * *